US008668408B2

(12) United States Patent
Foo et al.

(10) Patent No.: US 8,668,408 B2
(45) Date of Patent: Mar. 11, 2014

(54) SKIRTED FOUNDATION FOR PENETRATING SOFT MATERIAL

(75) Inventors: Kok Seng Foo, Singapore (SG); Chin Kau Quah, Singapore (SG); Okky Ahmad Purwana, Singapore (SG); Henry Krisdani, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 99 days.

(21) Appl. No.: 13/414,649

(22) Filed: Mar. 7, 2012

(65) Prior Publication Data

US 2012/0230773 A1 Sep. 13, 2012

(30) Foreign Application Priority Data

Mar. 9, 2011 (SG) ..... 201101762-1

(51) Int. Cl.
*E02D 5/74* (2006.01)
*E02D 7/24* (2006.01)

(52) U.S. Cl.
USPC ..... 405/224; 405/226

(58) Field of Classification Search
USPC ..... 405/196, 203, 224, 224.1, 226; 52/292
See application file for complete search history.

(56) References Cited

U.S. PATENT DOCUMENTS

| | | | | |
|---|---|---|---|---|
| 4,761,096 | A * | 8/1988 | Lin | 405/224.1 |
| 5,224,798 | A * | 7/1993 | Thomas | 405/198 |
| 2007/0059106 | A1 * | 3/2007 | Chow et al. | 405/203 |
| 2009/0269144 | A1 * | 10/2009 | Foo et al. | 405/224.1 |

* cited by examiner

*Primary Examiner* — John Kreck
*Assistant Examiner* — Stacy Warren
(74) *Attorney, Agent, or Firm* — Pyprus Pte Ltd

(57) ABSTRACT

The present invention provides a skirted foundation that can be used in a jack-up rig for providing enhanced bearing capacity. The skirted foundation comprises a spudcan footing having an upper part and a base, wherein the upper part and the base are coupled at their peripherals to form an outer edge, wherein both the upper part and the base have a flat or conical configuration, and wherein the upper part supports one leg of a jack-up rig, and the base has a flat bottom or downward slope, and a skirt having an upper end being integrally coupled to the spudcan footing and downwardly projected to encircle the base and a lower end for penetrating seabed, wherein the skirt comprises a plurality of circumferential openings adjacent to the base of the spudcan footing and located within the top half of the skirt height.

10 Claims, 3 Drawing Sheets

SKIRTED FOUNDATION FOR PENETRATING SOFT MATERIAL

FIELD OF THE INVENTION

The present invention relates generally to jack-up rigs, and more particularly to a foundation being suitable to be employed in a jack-up rig.

BACKGROUND OF THE INVENTION

A jack-up rig is an offshore oil and gas exploration drilling structure or a work-over platform being used in shallow water, typically in water with depths up to 500 feet. The jack-up rig usually comprises a floatable hull with a deck or working platform, and three or four legs, where the legs provide support for the floatable hull in elevated conditions. After the jack-up rig arrives at a location, its legs are lowered until the legs touch the underneath seabed and rest on the soil on the seabed. Then, the hull of the jack-up rig may be jacked up using a jacking system to raise the working platform of the jack-up rig above the water so that the jack-up rig is safe to be operated in open water situations where water movement is experienced.

The legs of a jack-up rig are commonly tubular columns or trusses, each truss comprising vertical chords connected with cross braces that are normally diagonally disposed. The legs normally terminate in a jack-up foundation that rests on the seabed. The foundation provides an enlarged bearing area so as to provide an adequate bearing capacity and reduce the pressure exerted on the soil of the seabed. Resultantly, this reduces the penetration depth of the legs that is required by the foundation to support the jack-up rig, allowing the jack-up rig to be operated in a greater variety of locations and soil types with the available leg length.

Modern jack-up rigs are typically equipped with individual spudcan footings which are connected to each leg of the jack-up rig. This allows the jack-up rig to be supported on uneven seabeds or slopes or in the cases whereby the elevation of each leg is needed to be independently adjusted relative to the other legs. A spudcan is typically shaped like a top, having a generally conical upper half connected to the leg and a generally conical lower half or base for contact with the seabed. The conical base helps ensure some penetration into the seabed, even in hard soils, so as to provide some anchoring of the legs into the seabed.

Since the spudcan footing may rest with a shallow penetration, which typically occurs in sandy or very stiff seabed, it is common that the resulting horizontal bearing capacity of the jack-up rig is relatively low compared to the anticipated horizontal load. In such situations, skirted or caisson foundations are typically adopted to provide a larger embedment effect of the footing into the founding stratum. The skirt or caisson effectively forms a vertical ring or tube that walls off the foundation from the surrounding seabed. If the self weight is insufficient to allow full penetration of the skirt, suction is typically applied within the internal skirt to create underpressure that results in further penetration of the skirt until reaching the design depth.

In most cases, the overall behavior of a skirted foundation can often be justifiably treated as an embedded solid foundation block with its base resting on the same depth as the skirt tip. The skirt not only improves the horizontal capacity but also increases combined bearing capacity of the shallow foundations by transferring the bearing load to a larger depth through soil mass confined within the skirt. The skirt is generally able to increase the bearing capacity in vertical, horizontal, and moment directions.

The full advantages of skirted or caisson foundations, however, may be hindered if soft material of significant thickness is present above the founding stratum. Although the very soft material may be thick and the resulting penetration of the spudcan footing is relatively deep, the horizontal capacity is still governed mostly by the effective spudcan base embedment into the founding stratum. After the foundation installation, the soft material trapped within the skirt, sandwiched between the foundation base and the founding stratum, may consolidate over time under operational load or result in significant additional settlements when subjected to design load. In addition, the skirt penetration may be limited by the trapped soft material which in turn results in significantly less skirt penetration into the founding stratum than designed for.

In order to ensure the effectiveness of the skirted foundation in such a soil condition, removal of the trapped soft material from the caisson interior is therefore critical, and challenging particularly for offshore applications. Certain suction pumps or eductor systems may be able to suck out soft material (of up to particular shear strengths and densities) from the caisson interior. However, it is difficult to ensure effective removal of the soft material by such a means particularly when it encompasses a large area underneath a foundation and involves a massive volume of soil.

One alternative for eliminating the soft material is ground preparation work such as excavation prior to foundation installation. However, under-water excavation in soft seabed is often problematic, if not impractical, particularly when the soft material is significantly thick. Additional means such as sheet piles installation may be required to prevent the surrounding soil from collapsing back to the excavated area. On the other hand, soil improvement technique might not be feasible or good enough to provide sufficiently stiff treated soil. Potential environmental pollution may also be of concern with applications of such methods.

In such a soil condition, piled foundation or its combination with shallow foundation systems can be designed to provide required bearing capacity. However, when a foundation system is required to be mobile, such as in the ease of jack-up rigs, use of piles or its combination therewith is not preferred since removal of the piled foundation is not practical.

SUMMARY OF THE INVENTION

One aspect of the present invention provides a skirted foundation. In one embodiment, the skirted foundation comprises a spudcan footing having an upper part and a base, wherein the upper part and the base are coupled at their peripherals to form an outer edge, wherein both the upper part and the base have a flat or conical configuration, and wherein the upper part supports one leg of a jack-up rig, and the base has a flat bottom or downward slope; and a skirt having an upper end being integrally coupled to the spudcan footing and downwardly projected to encircle the base and a lower end for penetrating seabed, wherein the skirt comprises a plurality of circumferential openings adjacent to the base of the spudcan footing and located within the top half of the skirt height, and wherein the openings are configured to allow soil to flow out of the interior space defined by the skirt and the base as the foundation descends into the seabed.

In another embodiment of the skirted foundation, the center of the base has a tip or a steeper conical configuration to facilitate the penetration into the seabed.

In another embodiment of the skirted foundation, the skirt comprises a plurality of spaced-apart and vertically disposed girders; wherein one or more openings may be located between the vertically disposed girders.

In another embodiment of the skirted foundation, the openings are configured to be closable by a means. In a further embodiment of the skirted foundation, the means for closing the openings is a sleeve, wherein the sleeve is provided at the outer edge for closing the openings. In yet another further embodiment of the skirted foundation, the sleeve is controlled by a pin-lock system; so that during penetration, the sleeve is held in a position to ensure that the openings remains open for outflow of soft material therethrough, and after the foundation reaches a target depth, the pin-lock system may be unlocked, releasing the sleeve to descend under its own weight or by a mechanical means to cover and close the openings.

Another embodiment of the skirted foundation further comprises a plurality of base jetting nozzles disposed underneath the base of the spudcan footing, wherein the base jetting nozzles are preferably evenly distributed and installed with the nozzles directing parallel to the flat bottom or downward slope of the base.

Another embodiment of the skirted foundation further comprises internal brackets to stiffen the connection between the skirt and the base. In a further embodiment of the skirted foundation, the internal brackets are a plurality of radial panels connecting the skirt and the base, and wherein the plurality of radial panels are preferably evenly distributed around the skirt, thereby dividing the interior space defined by the skirt and the base into a plurality of radial compartments.

Another embodiment of the skirted foundation further comprises a plurality of skirt tip jetting nozzles being disposed around the lower end of the skirt; so that the jetting provided by the skirt tip jetting nozzles may be used to loosen the adjacent soil and therefore ease soil resistance for further penetration.

Another embodiment of the skirted foundation further comprises a membrane being attached across outer or inner or both sides of the skirt to facilitate full penetration of the skirt in a founding layer, wherein the membrane is connected to a dedicated pressure line, serving as an interface to apply to the soil a positive or negative excess pressure, with respect to the ambient hydrostatic pressure.

Another aspect of the present invention provides a jack-up rig comprising a working platform, a plurality of legs, and a plurality of skirted foundations, wherein each leg has two ends, one end coupled to the working platform for providing support and the other end is coupled with one skirted foundation so that the skirted foundations provide anchor and support for the jack-up rig; wherein the skirted foundation comprises a spudcan footing having an upper part and a base, wherein the upper part and the base are coupled at their peripherals to form an outer edge, wherein both the upper part and the base have a flat or conical configuration, and wherein the upper part supports one leg of a jack-up rig, and the base has a flat bottom or downward slope; and a skirt having an upper end being integrally coupled to the spudcan footing and downwardly projected to encircle the base and a lower end for penetrating seabed, wherein the skirt comprises a plurality of circumferential openings adjacent to the base of the spudcan footing and located within the top half of the skirt height, and wherein the openings are configured to allow soil to flow out of the interior space defined by the skirt and the base as the foundation descends into the seabed.

In another embodiment of the jack-up rig, the center of the base has a tip or steeper conical configuration to facilitate the penetration into the seabed.

In another embodiment of the jack-up rig, the skirt comprises a plurality of spaced-apart and vertically disposed girders; wherein one or more openings may be located between the vertically disposed girders.

Another embodiment of the jack-up rig further comprises a plurality of base jetting nozzles disposed underneath the base of the spudcan footing, wherein the base jetting nozzles are preferably evenly distributed and installed with the nozzles directing parallel to the flat bottom or downward slope of the base.

Another embodiment of the jack-up rig further comprises internal brackets to stiffen the connection between the skirt and the base. In a further embodiment of the jack-up rig, the internal brackets are a plurality of radial panels connecting the skirt and the base, and wherein the plurality of radial panels are preferably evenly distributed around the skirt, thereby dividing the interior space defined by the skirt and the base into a plurality of radial compartments.

Another embodiment of the jack-up rig further comprises a plurality of skirt tip jetting nozzles being disposed around the lower end of the skirt; so that the jetting provided by the skirt tip jetting nozzles may be used to loosen the adjacent soil and therefore ease soil resistance for further penetration.

Another embodiment of the jack-up rig further comprises a membrane being attached across outer or inner or both sides of the skirt to facilitate full penetration of the skirt in a founding layer, wherein the membrane is connected to a dedicated pressure line, serving as an interface to apply to the soil a positive or negative excess pressure, with respect to the ambient hydrostatic pressure.

Another aspect of the present invention provides a method for installing a skirted foundation, wherein the skirted foundation comprises a spudcan footing having an upper part and a base, wherein the upper part and the base are coupled at their peripherals to form an outer edge, wherein both the upper part and the base have a flat or conical configuration, and wherein the upper part supports one leg of a jack-up rig, and the base has a flat bottom or downward slope, and a skirt having an upper end being integrally coupled to the spudcan footing and downwardly projected to encircle the base and a lower end for penetrating seabed, wherein the skirt comprises a plurality of circumferential openings adjacent to the base of the spudcan footing and located within the top half of the skirt height, and wherein the openings are configured to allow soil to flow out of the interior space defined by the skirt and the base as the foundation descends into the seabed; wherein the method comprises lowering the foundation into soft material on the seabed; and facilitating the outflow of the soft material from the interior space defined by the skirt and the base through the opening; thereby increasing the bearing capacity of the foundation.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides a skirted foundation that is used for example in a jack-up rig, where the skirted foundation is suitable for penetrating soft material. Briefly, the skirted foundation is configured to efficiently remove the soft material trapped in the interior of the skirt.

Figure 1:
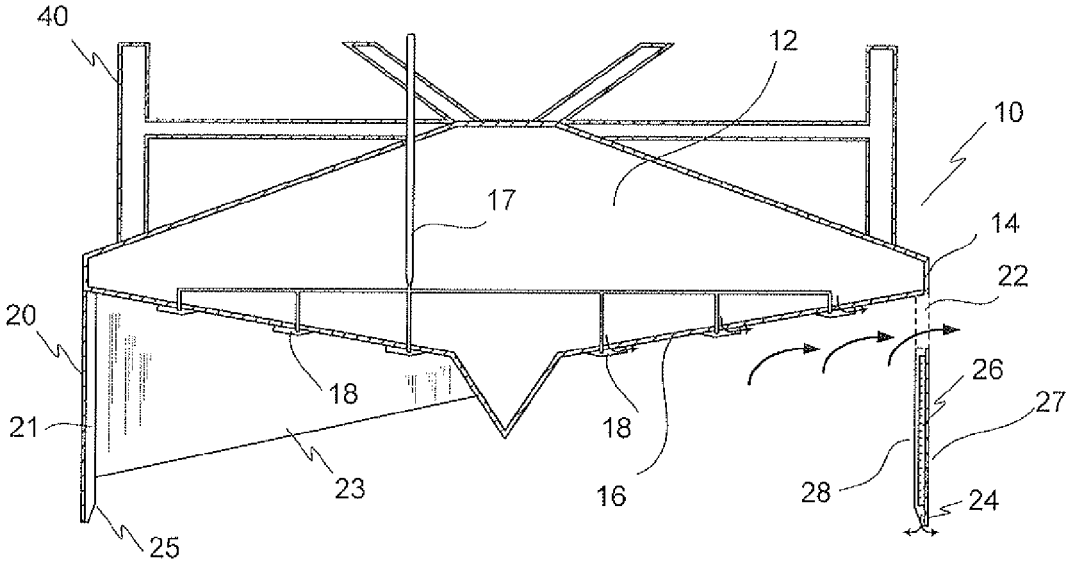
FIG. 1 shows a schematic cross-sectional view of an exemplary foundation in accordance with one embodiment of the present invention.

Referring now to FIG. 1, there is provided a cross sectional view of the skirted foundation in accordance with one embodiment of the present invention. As shown in FIG. 1, the foundation 10 comprises a spudcan footing 12, and a skirt 20 integrally coupled to the spudcan footing 12 and projected downwardly. The spudcan footing 12 comprises an upper part and a base 16, where the upper part and the base 16 are coupled at their peripherals to form an outer edge 14, and both the upper part and the base 16 have a conical configuration. The upper part supports one leg 40 of a jack-up rig, and the base 16 has a downward slope. It is to be noted that both the upper part and the base can have other configurations, for example, the base has a flat configuration with a flat bottom. The center of the base 16 has a tip or a steeper conical configuration to facilitate the penetration into the seabed. The skirt 20 has an upper end being integrally coupled to the spudcan footing 12, e.g., at the outer edge 14 to encircle the base 16, and a lower end 25 for penetrating the seabed. The location of the integration between the spudcan footing 12 and the skirt 20 is not limited to the outer edge while the outer edge is preferable for it provides larger interior space encircled by the skirt. The skirt 20 comprises a plurality of circumferential openings 22 adjacent to the base 16 of the spudcan footing 12 and located within the top half of the skirt height. The opening 22 shall be close to the base 16. If the distance between the base 16 and the openings 22 is too far, the soft soil might get stuck and accumulated in between. After installation, if the trapped soft soil between the base 16 and founding stratum is significant, the soft soil will reduce the bearing capacity and the consolidation during operational period will cause settlement of the spudcan footing. The upper end of the openings 22 is ideally at the base 16. Due to structural design considerations, there may be some gap required between the base 16 and the upper end of the openings. While the openings 22 is preferably located within the top half of the skirt height, the lower end of the openings 22 might be extended into the bottom half of the skirt height. In certain embodiments, the skirt 20 comprises a plurality of spaced-apart and vertically disposed girders 21, where one or more openings 22 may be located between the vertically disposed girders 21. The openings 22 are configured to allow soil to flow out of the interior space defined by the skirt 20 and the base 16 as the foundation 10 descends into the seabed. The conical configuration of the base 16 optimizes soil flow towards the openings 22.

In certain embodiments, the openings 22 are configured to be closable. For example, a dedicated sleeve (not shown) is provided at the outer edge 14 for closing the openings 22. The sleeve may be installed parallel to the skirt 20. The sleeve may be held in place by a pin-lock system during penetration so that the openings 22 remains open for outflow of soft material therethrough. After the foundation 10 reaches a target depth, the pin-lock system may be unlocked, releasing the sleeve to descend under its own weight or by a mechanical means to cover and close the openings 22. A stopper may be provided at an elevation below the openings 22 to control the final position of the sleeve when the openings 22 are closed. Closure of the openings 22 allows any void or soft material between the base 16 and founding stratum 34 to be replaced by a high density filler material 38.

The foundation 10 further comprises a plurality of base jetting nozzles 18 disposed underneath the base 16 of the spudcan footing 12 that are fed by a single or multiple jetting pressure lines 17. The base jetting nozzles 18 are preferably evenly distributed and installed with the nozzles directing parallel to the downward slope of the base 16. Jetting provided by the base jetting nozzles 18 is configured to assist with soil flow radially outward of the opening 22 during an initial stage of installation of the foundation 10 on the seabed 30, and also during further penetration once the foundation base 16 is in contact with a founding stratum 34 of the seabed 30. The jetting line provided by the base jetting nozzles 18 may also be used to inject the high density filler material 38 or grout to replace the soft material or to fill any void between the base 16 and founding stratum 34 after the foundation has reached its target depth.

The foundation 10 further comprises internal brackets to stiffen the connection between the skirt 20 and the base 16. In one embodiment, the internal brackets are a plurality of radial panels 23 connecting the skirt 20 and the base 16, where the plurality of radial panels 23 are preferably evenly distributed around the skirt 20, thereby dividing the interior space defined by the skirt 20 and the spudcan base 16 into a plurality of radial compartments. Such compartmentalization optimizes jetting pressure application by the base jetting nozzles 18 to ensure soil flow in the direction of the circumferential openings 22.

The foundation 10 further comprises a plurality of skirt tip jetting nozzles 24 being disposed around the lower end 25 of the skirt 20. The jetting provided by the skirt tip jetting nozzles 24 may be used to loosen the adjacent soil and therefore ease soil resistance for further penetration.

The foundation 10 further comprises a filter or membrane 26 being attached across outer 27 or inner 28 or both sides 27, 28 of the skirt 20 to facilitate full penetration of the skirt 20 in the founding layer. Connected to a dedicated pressure line, the membrane 26 serves as an interface to apply to the soil a positive or negative excess pressure, with respect to the ambient hydrostatic pressure. During skirt penetration at the founding layer, excess pressure can be generated to reduce the soil effective stress and thereby loosen the soil resistance. Where necessary, after installation, suction pressure can also be applied through the membrane 26 to preconsolidate the founding soil so as to make it stiffer.

Figure 3:
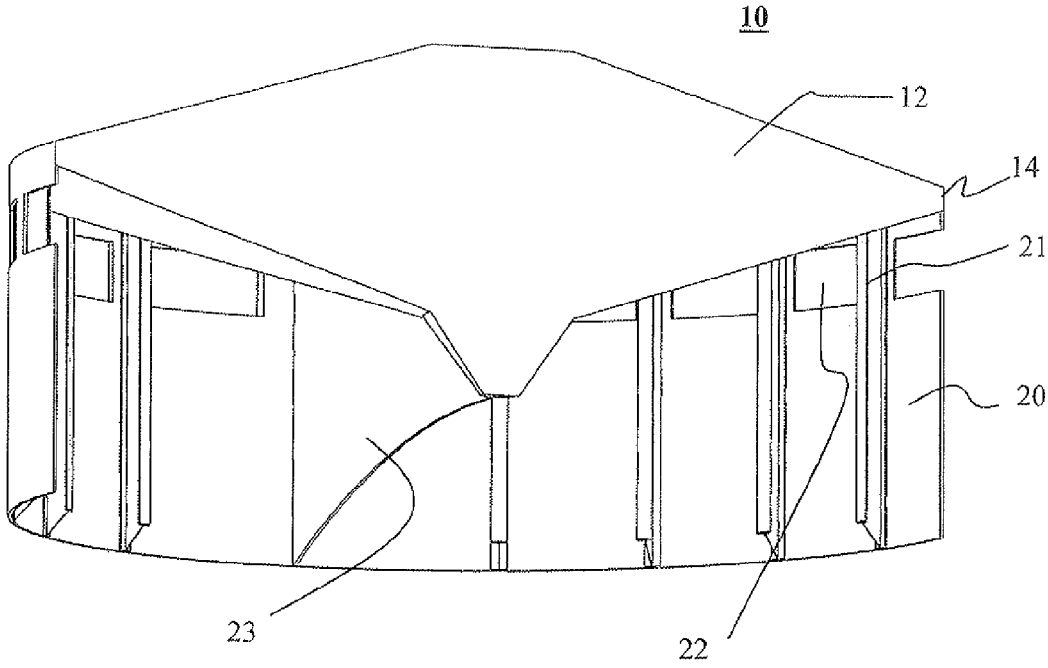
FIG. 3 shows an isometric cut-away view of an exemplary foundation in accordance with one embodiment of the present invention.

An isometric cut-away view of the skirted foundation in accordance with one embodiment of the present invention is shown in FIG. 3.

Figure 2:
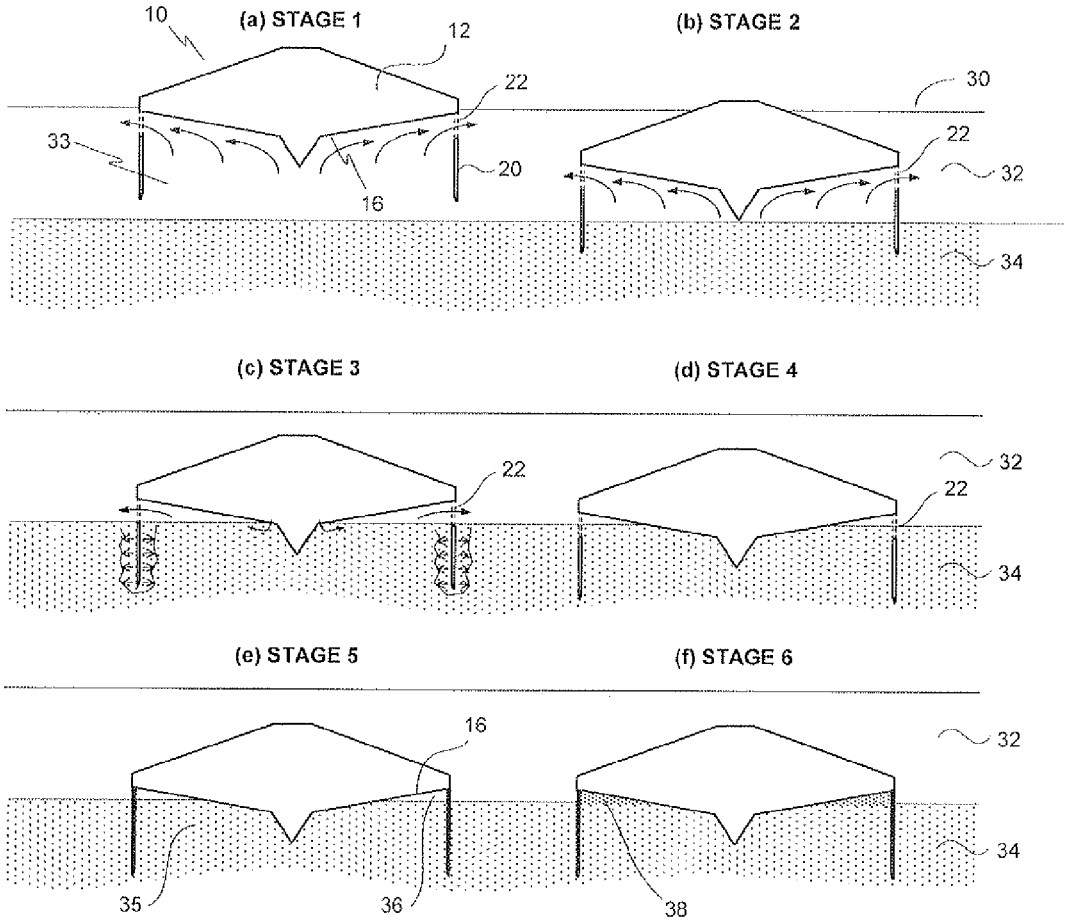
FIG. 2 shows various stages of the installation of the exemplary foundation as shown in FIG. 1.

Referring now to FIG. 2, there is provided an illustration of various stages of the installation of the foundation 10. During installation, the skirted foundation 10 is first penetrated into the soil 30 by gravity, i.e., via the dead load imposed by a hull of the jack-up rig through individual legs.

Stage 1. As the foundation 10 is advanced downwards into the soil 30 through the soft soil layer 32, as shown in FIG. 2(*a*), the soft material 33 within the peripheral skirt 20 is compressed and flows radially outwards and is discharged through the openings 22 on the upper part of the skirt 20. The action of the jetting by the base jetting nozzles 18 at the spudcan base 16 softens and eases the flow of the soft soil 33 out of the openings 22.

Stage 2. Once the lower end 25 of the skirt touches the founding layer 34 of the soil 30, further loading of the foundation 10 will squeeze the soft material 33 inside the skirt 20, further displacing the soft material 33 out of the opening 22. Displacing the soft material 33 within the skirt 20 allows the lower end 25 to advance further into the founding layer 34 under the imposed load, as shown in FIG. 2(*b*).

Stage 3. If resistance occurs, excess pressure can be applied across the skirt interfaces 27, 28 through the membrane 26 as shown in FIG. 2(*c*). The applied pressure is aimed at reducing the effective stress of the soil. Such reduction in the effective stress and thus frictional resistance of the skirt enables the lower end 25 to penetrate further into the founding stratum 34.

Stage 4. Where necessary, jetting pressure can be applied through the skirt tip jetting nozzles 24 at the lower end 25 to loosen the immediate soil and ease the soil resistance until the lower end 25 reaches the target penetration depth as shown in FIG. 2(*d*).

Stage 5. If required, the openings 22 can be closed by mechanical means such as the sleeve described above, to provide more confinement to the soil 35 inside the skirt 20 as shown in FIG. 2(*e*). This is to facilitate replacement of the soft material or filling of any void 36 as the interface between the base 16 of the spudcan 12 and the soil 34, as described below.

Stage 6. Any gap 36 between the foundation base 16 and the founding stratum 34 can be filled with high density filler material 38 such as sand, barite, grout, etc., as shown in FIG. 2(*f*). The jetting line of base jetting nozzles 18 at the foundation base 16 may be used or a dedicated filler line (not shown) may be provided for this purpose. The filled gap 38 will provide stiffer foundation response especially against rotation loads.

Removal of soft material under the foundation base 16 through the openings 22 provided in the skirt 20 thus ensures the embedment of the skirt into the founding layer 34. Besides increasing the effective foundation capacity and stiffness, equally importantly, it minimizes settlement due to consolidation or compression of any soft material during the application of design load. Providing the openings 22 in the skirt 20 also avoids the need for use of special pumps or ground preparation work which may be not practical or effective in certain situations or soil conditions.

Another aspect of the present invention provides a jack-up rig comprising a working platform, a plurality of legs, and a plurality of skirted foundations, wherein each leg has two ends, one end coupled to the working platform for providing support and the other end is coupled with one skirted foundation so that the skirted foundations provide anchor and support for the jack-up rig. The skirted foundations have been described above. The jack-up rig of the present invention has enhanced bearing capacity.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A skirted foundation comprising:

a spudcan footing having an upper part and a base, wherein the upper part and the base are coupled at their peripherals to form an outer edge, wherein both the upper part and the base have a flat or conical configuration, and wherein the upper part supports one leg of a jack-up rig, and the base has a flat bottom or a downward slope; and a skirt having an upper end being integrally coupled to the spudcan footing and downwardly projected to encircle the base and a lower end for penetrating seabed, wherein the skirt comprises a plurality of circumferential openings adjacent to the base of the spudcan footing and located within the top half of the skirt height, and wherein the openings are configured to allow soil to flow out of the interior space defined by the skirt and the base as the foundation descends into the seabed.

2. The skirted foundation of claim 1, wherein the center of the base has a tip or steeper conical configuration to facilitate penetration into the seabed.

3. The skirted foundation of claim 1, wherein the skirt comprises a plurality of spaced-apart and vertically disposed girders; wherein one or more openings are located between the vertically disposed girders.

4. The skirted foundation of claim 1, further comprising a plurality of base jetting nozzles disposed underneath the base of the spudcan footing, wherein the base jetting nozzles are evenly distributed and installed with the nozzles directed parallel to the flat bottom or downward slope of the base.

5. The skirted foundation of claim 1, further comprising internal brackets to stiffen the connection between the skirt and the base.

6. The skirted foundation of claim 5, wherein the internal brackets are a plurality of radial panels connecting the skirt and the base, and wherein the plurality of radial panels are evenly distributed around the skirt, thereby dividing the interior space defined by the skirt and the base into a plurality of radial compartments.

7. The skirted foundation of claim 1, further comprising a plurality of skirt tip jetting nozzles being disposed around the lower end of the skirt; so that the jetting provided by the skirt tip jetting nozzles is used to loosen the adjacent soil and therefore ease soil resistance for further penetration.

8. A method for installing a skirted foundation, wherein the skirted foundation comprises a spudcan footing having an upper part and a base, wherein the upper part and the base are coupled at their peripherals to form an outer edge, wherein both the upper part and the base have a flat or conical configuration, and wherein the upper part supports one leg of a jack-up rig, and the base has a flat bottom or downward slope, and a skirt having an upper end being integrally coupled to the spudcan footing and downwardly projected to encircle the base and a lower end for penetrating seabed, wherein the skirt comprises a plurality of circumferential openings adjacent to the base of the spudcan footing and located within the top half of the skirt height, and wherein the openings are configured to allow soil to flow out of the interior space defined by the skirt and the base as the foundation descends into the seabed; wherein the method comprises:

lowering the foundation into soft material on the seabed; and facilitating the outflow of the soft material from the interior space defined by the skirt and the base through the openings;

thereby increasing the bearing capacity of the foundation.

9. The method of claim 8, further comprising:

providing base jetting nozzles underneath the base of the spudcan footing so that water jetting from the base jetting nozzles facilitates the outflow of the soft material through the openings.

10. The method of claim 8, further comprising:

providing skirt tip jetting nozzles at the lower end of the skirt so that water jetting from the skirt tip jetting nozzles eases soil resistance for facilitating penetration of the skirt.

* * * * *